US008158249B2

(12) United States Patent
Greer

(10) Patent No.: US 8,158,249 B2
(45) Date of Patent: Apr. 17, 2012

(54) MULTI-LAYERED FOAM FURNITURE METHOD AND APPARATUS

(75) Inventor: Bruce Greer, Knoxville, TN (US)

(73) Assignee: Featherlyte, LLC, Louisville, TN (US)

( * ) Notice: Subject to any disclaimer, the term of this patent is extended or adjusted under 35 U.S.C. 154(b) by 334 days.

(21) Appl. No.: 12/124,836

(22) Filed: May 21, 2008

(65) Prior Publication Data

US 2008/0292830 A1 Nov. 27, 2008

Related U.S. Application Data

(60) Provisional application No. 60/939,206, filed on May 21, 2007.

(51) Int. Cl.
*B32B 27/08* (2006.01)
*B05D 1/36* (2006.01)

(52) U.S. Cl. ..... 428/319.3; 428/319.7; 428/318.4; 427/407.1; 427/412.1

(58) Field of Classification Search ..... 428/318.4, 428/319.3, 319.7; 427/407.1, 412.1
See application file for complete search history.

(56) References Cited

U.S. PATENT DOCUMENTS

| | | | | |
|---|---|---|---|---|
| 3,890,658 | A * | 6/1975 | Petersilie | 5/2.1 |
| 3,973,281 | A | 8/1976 | Davis et al. | |
| 4,731,279 | A * | 3/1988 | Isshiki | 428/159 |
| 5,087,514 | A | 2/1992 | Graefe | |
| 5,681,090 | A * | 10/1997 | St. Thomas | 297/440.14 |
| 6,698,149 | B1 * | 3/2004 | Ruchgy | 52/309.4 |
| 7,213,885 | B2 * | 5/2007 | White et al. | 297/440.1 |
| 2002/0041954 | A1 | 4/2002 | Henrichs et al. | |
| 2002/0178672 | A1 * | 12/2002 | Robinson et al. | 52/309.1 |
| 2004/0126557 | A1 * | 7/2004 | Thiele et al. | 428/304.4 |
| 2005/0064128 | A1 * | 3/2005 | Lane et al. | 428/44 |
| 2006/0003044 | A1 * | 1/2006 | DiNello et al. | 425/412 |
| 2008/0029000 | A1 | 2/2008 | Thornbury et al. | |
| 2008/0078134 | A1 * | 4/2008 | Roby | 52/309.9 |

FOREIGN PATENT DOCUMENTS

| | | |
|---|---|---|
| WO | 9414587 | 7/1994 |
| WO | WO 9718735 A1 * | 5/1997 |

* cited by examiner

*Primary Examiner* — Hai Vo
(74) *Attorney, Agent, or Firm* — Luedeka Neely Group, P.C.

(57) ABSTRACT

A method and apparatus regarding lightweight but robust multi-layered foam furniture pieces. The furniture pieces include a foam base, a polymeric solidifying layer, and a decorative layer. The decorative layer may include an acrylic-based surface finish and/or one or more decorative pieces, tiles, or other variously shaped objects attached to the primer layer and/or part of the decorative layer. Other embodiments include additional layers.

16 Claims, 15 Drawing Sheets

MULTI-LAYERED FOAM FURNITURE METHOD AND APPARATUS

This application claims priority to provisional patent application Ser. No. 60/939,206 titled MULTI-LAYERED FOAM FURNITURE METHOD AND APPARATUS filed May 21, 2007, the entire contents of which are incorporated herein by reference.

FIELD

This disclosure relates to the field of lightweight furniture. More particularly, this disclosure relates to multi-layered foam furniture and methods for making such furniture.

BACKGROUND

Modern furniture designs, particularly for outdoor furniture, have evolved such that stone, brick, coral, stucco, and other heavy masonry looks are increasingly popular. These looks include chairs, sofas, and other furniture pieces that are made in part or in whole from one or more types of these heavy materials. Such elegant furniture designs, however, have significant drawbacks including high manufacturing costs, little or no flexibility (e.g., for moving from one location to another), and expensive repair costs.

What is needed, therefore, is a product that offers the same look and feel of furniture made from heavy materials, but without the drawbacks associated with such products.

SUMMARY

The above and other needs are met by a multi-layered foam furniture piece including a foam base, a polymeric solidifying layer attached adjacent to the foam base, and a decorative layer attached adjacent to the polymeric solidifying layer. In a related embodiment the multi-layered foam furniture piece includes a plurality of furniture portions attached adjacent to each other to form the foam base. In another embodiment, the multi-layered foam furniture piece further includes at least one design plate attached adjacent to the polymeric solidifying layer. In a related embodiment, the multi-layered foam furniture piece includes a primer layer attached adjacent to at least part of the polymeric solidifying layer and proximate to the decorative layer.

In another embodiment, a multi-layered foam furniture piece including a foam base, a polymeric solidifying layer attached adjacent to the foam base, and a decorative layer attached adjacent to the polymeric solidifying layer further includes a polymer cement layer attached adjacent to the decorative layer. In a related embodiment, the multi-layered foam furniture piece includes a mesh netting patch attached proximate to the polymeric solidifying layer. In yet another related embodiment the multi-layered foam furniture piece with the polymer cement layer includes a pigment layer attached adjacent to the polymer cement layer. In another related embodiment the multi-layered foam furniture piece with the polymer cement layer and the pigment layer further includes a sealant layer attached adjacent to the pigment layer.

Another embodiment includes an auxiliary furniture piece component including a fashioned composite panel, a polymer cement layer attached adjacent to the surface of the composite panel, and a pigment layer attached adjacent to the polymer cement layer.

In another embodiment, the invention described herein also includes a method of making a multi-layered foam furniture piece including the steps of (a) cutting a first foam block to a first desired shape including a first furniture portion; (b) applying a polymeric solidifying layer to at least part of the outer surface area of the first furniture portion; and (c) applying a decorative layer to the first furniture portion. Another embodiment includes the method of making a multi-layered foam furniture piece wherein the step (b) further includes a step of reinforcing the polymeric solidifying layer by applying a mesh netting patch adjacent to the polymeric solidifying layer.

A related embodiment includes a further step (d) of applying a primer layer adjacent to the polymeric solidifying layer. A related embodiment further includes a step (e) of attaching a design plate to the primer layer.

Another embodiment includes an alternate step (d) of applying a polymer cement layer adjacent to the decorative layer. A related embodiment includes a step (e) of applying a pigment layer adjacent to the polymer cement layer. Another related embodiment includes a step (f) of applying a sealant layer adjacent to the polymer cement layer. Another related embodiment includes a step of applying a sealant layer proximate to the pigment layer. A further embodiment includes the method of making a multi-layered foam piece of furniture wherein (i) step (a) further includes the steps of (1) cutting a second foam block to a second desired shape including a second furniture portion, and (2) attaching the first furniture portion to the second furniture portion to form a foam base; (ii) step (b) further includes a step of applying a polymeric solidifying layer adjacent to the outer surface area of the foam base; and (iii) step (c) further includes a step of applying a decorative layer adjacent to the foam base. A related embodiment further includes a step (d) of applying a polymer cement layer adjacent to the decorative layer; and a step (e) of applying a pigment layer adjacent to the polymer cement layer.

In another embodiment, the invention described herein also includes a method for making an auxiliary furniture piece component including the steps of (a) fashioning the composite panel into a desired shape; (b) applying the polymer cement layer adjacent to the fashioned composite panel; and (c) applying the pigment layer adjacent to the polymer cement layer.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense).

Adjacent: The term "adjacent" is intended to mean "near but not necessarily touching or directly next to a separate object."

EPS: The term "EPS" refers to "expanded polystyrene foam."

Foam: The term "foam" is intended to mean a light substance having a density ranging from about 1 pcf to about 3 pcf. Some specific examples include EPS foam, XPS foam, polyurethane foam, polyethylene foam, and PVC foam.

Foam base: The term "foam base" is intended to mean a foam structure that may include one or more foam sub-structures that have been attached adjacent to one another.

Layer: The term "layer" is defined broadly to mean a three-dimensional space and matter occupied therein, wherein the matter that has a first level of homogeneity throughout. A "layer" may include a plurality of sub-layers such that a sub-layer has a second level homogeneity throughout the sub-layer, wherein the second level of homogeneity is greater than the first level of homogeneity. A sub-layer may further include a plurality of sub-sub-layers such that a sub-sub-layer includes a third (increased) level of homogeneity throughout the sub-sub-layer, wherein the third level of homogeneity is greater than the second level of homogeneity.

Proximate: The term "proximate" is intended to mean "in direct contact with at least part of a separate object."

pcf: The term "pcf" refers to "pounds per cubic foot."

psi: The term "psi" refers to "pounds per square inch."

PVC: The term "PVC" refers to polyvinylchloride.

XPS: The term "XPS" refers to "extruded polystyrene foam."

Figure 1:
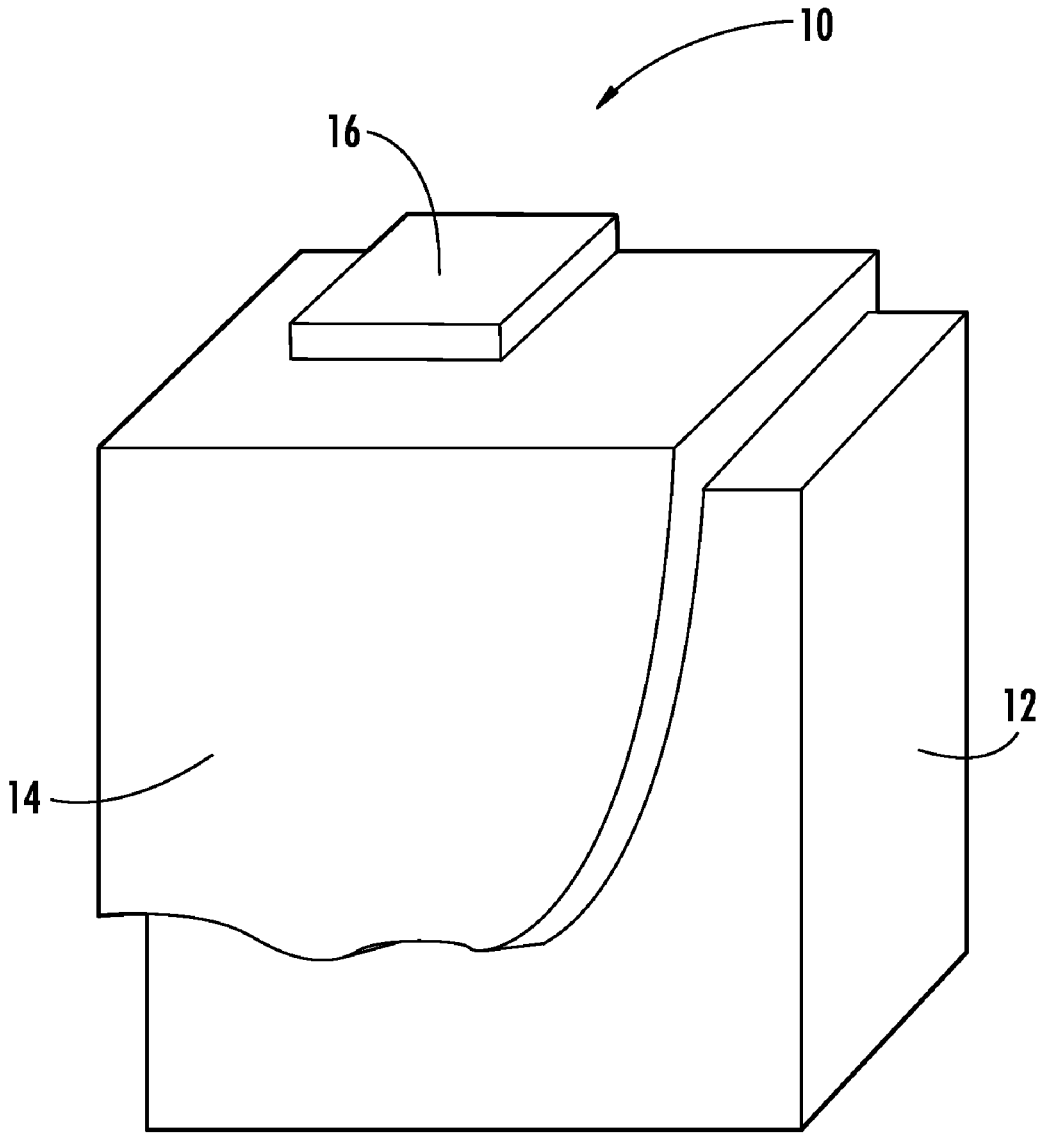
FIG. 1 shows a perspective layered view of a general embodiment of a multi-layered foam furniture piece.

Referring now to the figures, FIG. 1 depicts a basic embodiment of a multi-layered foam furniture piece 10. The general embodiment shown in FIG. 1 includes a foam block 12, preferably made from expanded polystyrene foam (EPS). The foam block 12 is at least partially covered by a polymeric solidifying layer 14. A decorative layer 16 is then applied proximate or adjacent to the polymeric solidifying layer 14. In certain embodiments described herein, the decorative layer 16 is the outermost layer (i.e., some of the embodiments that include a primer layer as discussed below in more detail).

The foam block 12 is most preferably made of two pcf EPS foam. More specifically, the foam used for the foam block 12 is contemplated to preferably include a flexural strength ranging from about 43 pounds per square inch (psi) to about 75 psi, more preferably from about 50 psi to about 66 psi, and most preferably about 58 psi. Also, the foam used for block 12 is contemplated to preferably include a tensile strength ranging from about 51 psi to about 74 psi, more preferably from about 56 psi to about 68 psi, and most preferably about 62 psi. Additionally, the foam used for block 12 is contemplated to preferably include a shear strength ranging from about 53 psi to about 92 psi, more preferably from about 60 psi to about 80 psi, and most preferably about 70 psi. The foam block 12 is further contemplated to be made from other foams known to a person having ordinary skill in the art and may include, for example, extruded polystyrene foam (XPS), polyurethane foam, polyethylene foam, and/or PVC foam.

The polymeric solidifying layer 14 typically includes polyurethane, but may additionally (or alternatively) include polyurea or other similar polymeric materials capable of existing as a robust polymeric layer on the foam block 12. One example of a material for use as the polymeric solidifying layer 14 is STYROETHANE 5321, available from ITW Devcon Futura Coatings of St. Louis, Mo.

The decorative layer 16 may include one or more applications of a coating applied adjacent to the polymeric solidifying layer 14, wherein the coating may include an acrylic-based surface finish. Such finishes are often sprayed on and cure very rapidly. A specific example of a material for use as the decorative layer 16 includes Sto Decocoat, available from Sto Corp. of Atlanta, Ga. Another example includes Sto Granitex, also available from Sto Corp. of Atlanta, Ga. Other specific examples of materials that may be sprayed on as the decorative layer 16 include artificial stucco layers available from Sto Corporation of Atlanta, Ga. or from Dryvit Systems, Inc. of West Warwick, R.I. Yet another example of a material for use as the decorative layer 16 includes an artificial sprayed on stone layer (Ameristone™) also available from Dryvit Systems, Inc. of West Warwick, R.I. Although specific examples of sprayed on decorative layers such as decorative layer 16 have been given herein, many sprayed on decorative layers simulating many different types of finishes known to those skilled in the art may be used.

Additionally or alternatively, the decorative layer 16 may include one or more decorative pieces, tiles, or other variously shaped objects (collectively, "decorative plates") attached adjacent to the polymeric solidifying layer 14. Such decorative plates may be made from materials including, for example, glass fiber reinforced plastic, metal, acrylic, and/or polyurethane foam. Glass fiber reinforced plastic decorative panels are available, for example, from TOTALStoneSouth, LLC (d/b/a TOTALStoneUSA.com) of Alpharetta, Ga. Metal decorative panels are available, for example, from Van Dyke's Restorers of Mitchell, S. Dak. Acrylic panels are available from Replications Unlimited of Saint Louis, Mo. Polyurethane foam decorative panels are available from, for example, Barron Designs, Inc. (d/b/a FauxPanels.com) of Deer Park, N.Y. and Replications Unlimited of St. Louis, Mo. The decorative plate(s) is preferably attached using an adhesive such as, for example, Great Stuff™ available from Dow Chemical Company of Midland, Mich. or Foam-Lok™ available from LaPolla Industries, Inc. of Houston, Tex. Although adhesives are preferred, any material and/or method for attaching decorative plates to a substrate known to those skilled in art may be used.

Figure 2:
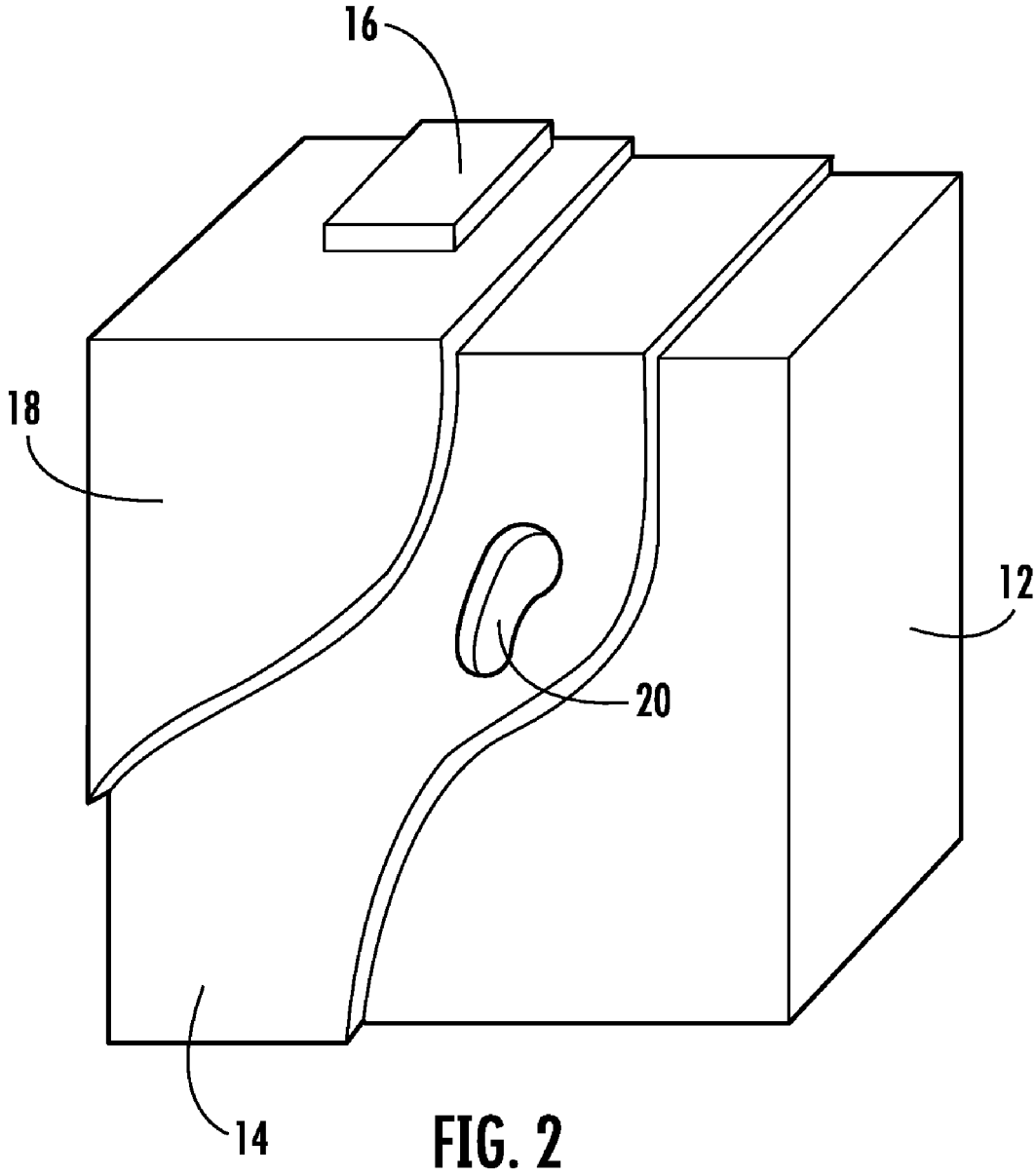
FIG. 2 shows a perspective layered view of an embodiment of a multi-layered foam furniture piece that includes a primer layer.

In one embodiment, an example of which is shown in FIG. 2, a primer layer 18 covers at least part of the polymeric solidifying layer 14. In this particular embodiment, the primer layer 18 prepares the polymeric solidifying layer 14 so that further layers may be attached thereto. When used, the primer layer 18 preferably includes an adhesive waterborne flexible primer/surfacer for preparing the polymeric solidifying layer 14 for binding with an additional layer or layers. One example of a material for use as the primer layer 18 is STYRO-BOND™ 405, available from ITW Devcon Futura Coatings of St. Louis, Mo. As shown in FIG. 2, gaps 20 may be present in areas where the primer layer 18 does not completely cover the polymeric solidifying layer 14. The primer layer 18 may act as an adhesive. Alternatively or additionally, the primer layer 18 may act as a surfacing agent for increasing the surface area for an additional layer or layers to attach to the primer layer 18. The thickness of the primer layer preferably ranges from about 1 to about 5 mils, and most preferably ranges from about 1 to about 3 mils.

For embodiments that include the primer layer 18, additional protective layers may be added to the decorative layer 16 to protect the overall furniture piece 10 from, for example, moisture or UV radiation. An example of an additional layer or layers includes a silicone based material such as Sto Lotusan®, available from Sto Corporation of Atlanta, Ga. Although a silicone-based example has been given, any additional layer or layers that offer protection from the elements to the furniture piece 10 may be used.

Figure 3A:
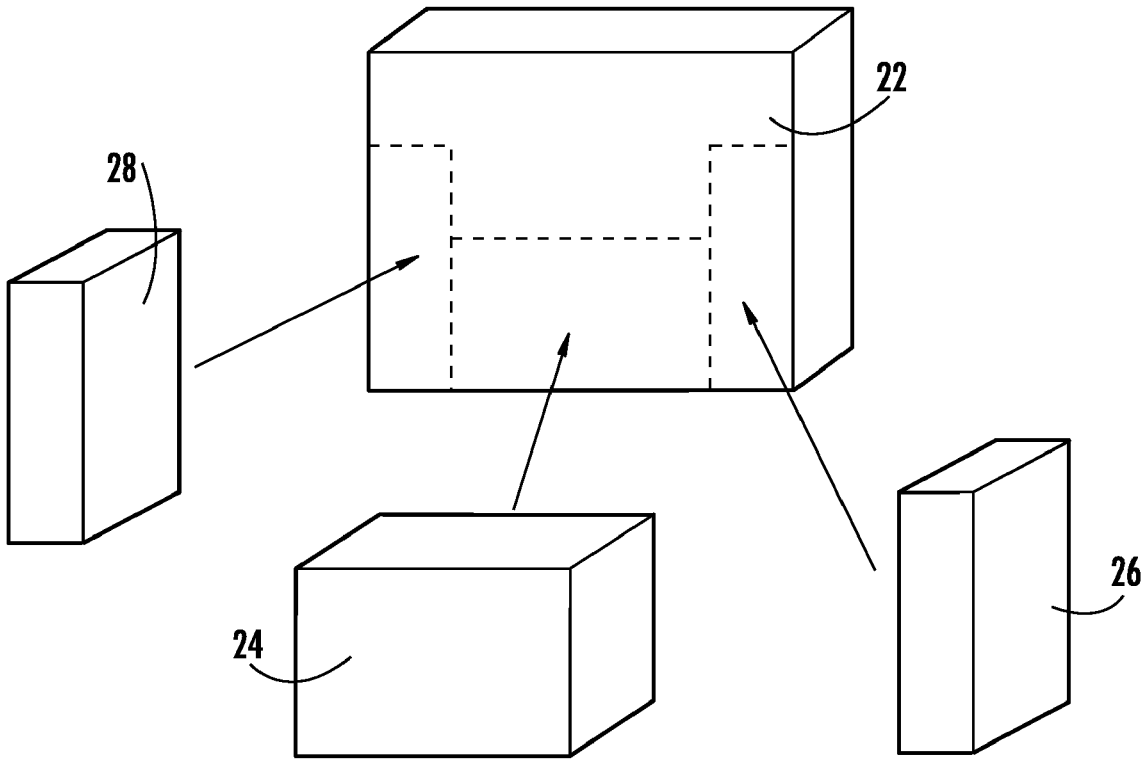
FIG. 3A shows an exploded view of a foam base of an embodiment of a multi-layered foam furniture piece.
Figure 3B:
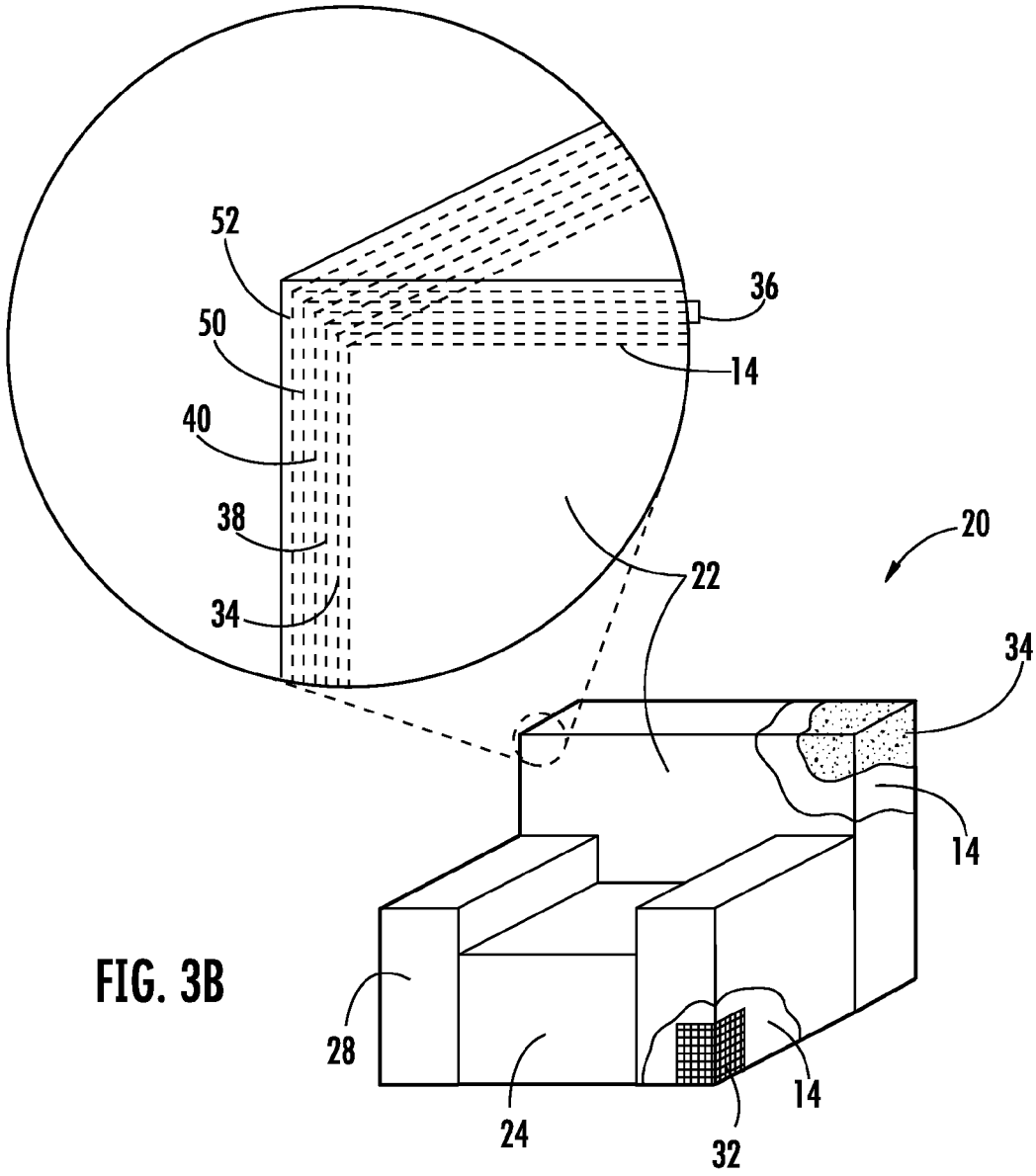
FIG. 3B shows a perspective layered view of an embodiment of a multi-layered foam furniture piece.

In a particularly preferred embodiment shown in FIG. 3A, a foam furniture piece 20 is shown that includes a foam base 22 made from 2 pcf EPS foam. The foam base 22 is made from a plurality of foam blocks that have been attached together, the foam blocks including a back foam block 24, a bottom foam block 26, a first side foam block 28, and a second side foam block 30. The plurality of foam blocks are preferably attached together using an adhesive as shown in FIG. 3B; however, other attachment techniques are contemplated. Although four foam blocks are described with regard to this particular embodiment, any number of foam blocks of various shapes and sizes may be used to form a foam base. The foam base 22, like foam block 12, is at least partially covered with the polymeric solidifying layer 14. In this embodiment, the polymeric solidifying layer 14 includes a polyurethane polymer mixture that has an extended pot life (e.g., greater than 10 minutes and preferably at least about 30 minutes) before the polyurethane polymer mixture becomes "tacky" (i.e., highly viscous) and difficult to apply to a surface. Using a solidifying mixture with an extended pot life is advantageous in certain embodiments because more time is available for careful application of the polymeric solidifying layer 14. The polyurethane polymer mixture may be troweled, rolled, brushed or sprayed, for example, on the foam base 22 until at least a part of the foam base 22 is covered by the polymeric solidifying layer 14. A specific example of a polyurethane polymer mixture that has been used as described herein includes Poly 880 available from Concrete Coatings of Mesa, Ariz. Other similar polyurethane, polyurea, or other similar polymer or copolymers known to a person having ordinary skill in the art are contemplated for use as the polymeric solidifying layer.

One or more mesh netting patches 32 may be attached to the polymeric solidifying layer 14, preferably while the solidifying layer 14 is still tacky and before the solidifying layer has substantially hardened. Typically, the polymeric solidifying layer 14 will become substantially hard around about twenty-four hours after the application of the solidification layer 14. The mesh netting patches 32 are preferably made of fiberglass and preferably include an adhesive backing on one side of the mesh netting. The mesh netting 32 is preferably used to reinforce the strength of all or part of the surface of the furniture piece 20. For example, as shown in FIG. 3B, mesh netting 32 is preferably used along corners and the base of the furniture piece 20 because such areas are more prone to damage from contact with other objects.

A decorative layer in the form of an aggregate layer 34 is applied adjacent the polymeric solidifying layer 14, preferably before the polymeric solidifying layer 14 substantially hardens. The aggregate layer 34 preferably includes, for example, crushed rock (e.g., grit stone), grit sand (preferably, 16 grit sand), joint sand, or other similar aggregate material known to a person having ordinary skill in the art so that the furniture piece 20 has the appearance of stone, rock, or other similar natural material. Preferably, the size of aggregate particles used to form most or all of the aggregate layer 34 ranges from about $6.0\times10^{-2}$ mm to about 2.0 mm.

A polymer cement layer 36 is located adjacent the aggregate layer 34 and the polymer cement layer 36 preferably covers substantially the entire aggregate layer 34. The polymer cement layer 36 preferably includes a first polymer cement layer 38 and a second polymer cement layer 40. Preferably, the first polymer cement layer 38 further includes a first polymer cement layer first coat and a first polymer cement layer second coat. The first polymer cement layer consists essentially of a mixture of Type I/II Portland Cement and quartz silica sand, wherein the quartz content preferably exceeds 90% of a total aggregate filler in the mixture. A specific example includes CS-100 Aggregate Base offered by CenturyStone Concrete Coatings of Mesa, Ariz. Other similar cement mixture known to a person having ordinary skill in the art are contemplated.

The second polymer cement layer 38 also preferably includes a second polymer cement layer first coat and a second polymer cement layer second coat. The second polymer cement layer consists essentially of a mixture of white portland cement and quartz silica sand wherein the quartz content preferably exceeds 90% of a total aggregate filler in the mixture. A specific example includes CS-500 Aggregate Texture offered by CenturyStone Concrete Coatings of Mesa, Ariz. Other similar cement mixture known to a person having ordinary skill in the art are contemplated.

In the embodiment shown in FIG. 3B, the furniture piece 20 further includes a pigment layer 50, wherein the pigment layer 50 includes oxide pigments such as, for example, titanium oxide to give a white colored finish. Generally, oxide pigments that may be used are in the form of mixtures that include one or more types of crushed metal oxide, aggregate filler(s), and water. Various color finishes may be achieved using different metal oxides known to a person having ordinary skill in the art. Specific examples of metal oxide pigment products that may be used to form the pigment layer 50 include 101-Burnt Umber, 102-Raw Umber, 103-Lamp Black, 104-Brown Oxide, 105-Yellow Oxide, 106-Red Oxide, 107-Sedona Buff, 108-Terra Cotta, all of which are available from CenturyStone Concrete Coatings of Mesa, Ariz.

The furniture piece 20 shown in FIG. 3B also includes a sealant layer 52 for substantially sealing the pigment layer 50 and the polymer cement layer 36. The sealant layer 52 includes a solvent-based acrylic copolymer sealing agent such as, for example, a butyl acrylic copolymer. A specific example of a product that may be used for this purpose is CSR-700 Diamond Glaze available from CenturyStone Concrete Coatings of Mesa, Ariz. Other similar polymer sealing products known to a person having ordinary skill in the art are contemplated.

Figure 4A:
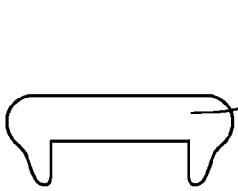
FIG. 4A shows a cutaway view of an embodiment of an arm rest member.
Figure 4B:
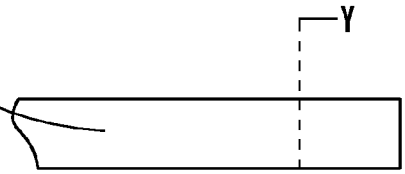
FIG. 4B shows a side view of an embodiment of an arm rest member.
Figure 4C:
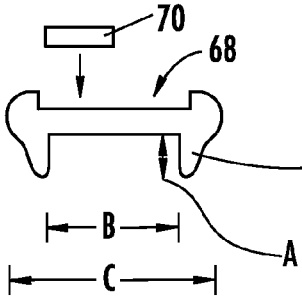
FIG. 4C shows a cutaway view of an embodiment of an arm rest member.
Figure 4D:
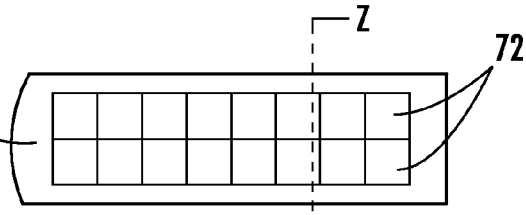
FIG. 4D shows a top view looking down on an embodiment of an arm rest member.
Figure 4E:
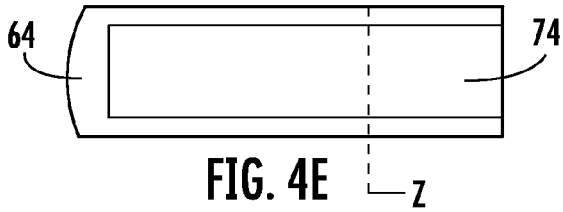
FIG. 4E shows a bottom view looking up at an embodiment of an arm rest member.
Figure 5:
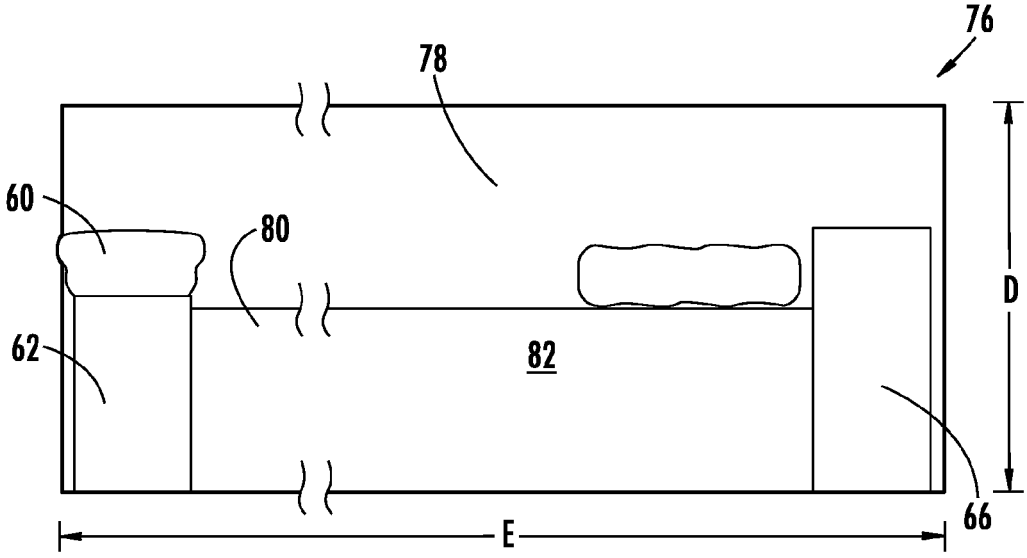
FIG. 5 shows a frontal view of an embodiment of a partially completed multi-layered foam furniture piece.

FIGS. 4A-4D show views of two embodiments of arm rests as used with the embodiments of the multilayered furniture pieces described herein that do not include the polymer cement layer 36. FIG. 4A shows a cutaway view (along line Y-Y as seen in FIG. 4B) of a first arm rest member 60. The first arm rest member fits, for example, over a first side foam block 62 as shown in FIG. 5. FIGS. 4C-4E show a second arm rest member 64—an alternative embodiment of an armrest member—that may fit over a side foam block such as the first side foam block 62 or a second side foam block 66. In order to provide permanent fixation, the arm rest members may be adhered to a foam block using an adhesive or other attachment means known to a person having ordinary skill in the art. FIG. 4C shows a cutaway view (along line Z-Z as seen in FIGS. 4D-4E) of the second arm rest member 64. Second arm rest member 64 includes a depression 68 for attaching decorative plates such as tile 70. FIG. 4D shows a view looking down into the depression 68 wherein the depression 68 is filled with a plurality of tiles 72. Decorative plates such as the tiles 72 are preferably attached to the second arm rest member 64 by an adhesive such as, for example, premixed thinset tile mortar. However, resin-based mortar such as epoxy thin set mortar or any other material capable of securing decorative plates to the second arm rest member 64 may be used. If the second arm rest member 64 is to be used on a furniture piece outdoors, tiles 72 are preferably porcelain tiles. FIG. 4E shows a view looking at the bottom of the second arm rest member 64, showing a channel 74 into which a side foam block (e.g., first side foam block) fits.

The depression 68 in the second arm rest member 64 preferably has a depth ranging from about 0.05 inches to about 2.5 inches and more preferably ranging from about 0.15 inches to about 0.5 inches. The depth of the depression 68 is most preferably about 0.25 inches. The depth "A" of the arm rest member channel 74 preferably ranges from about 0.1 inches to about 5.0 inches, more preferably ranges from about 0.5 inches to about 1.5 inches, and is most preferably about 1.0 inch. The inside width "B" of the arm rest member channel 74 preferably ranges from about 5 inches to about 40 inches, more preferably from about 9 inches to about 11 inches, and most preferably is about 10 inches. The overall width "C" of the second arm rest member 64 (and the first arm rest member 62) preferably ranges from about 5.0 inches to about 40.0 inches, more preferably from about 11.0 inches to about 14.0 inches, and most preferably is about 12.75 inches.

FIG. 5 shows a foam base 76 including the first side foam block 62, the second side foam block 66, a back foam block 78, and a bottom foam block 80. The foam base 76 shown in FIG. 5, is substantially covered with a polymeric solidifying layer 82 that is substantially similar to the polymeric solidifying layer 14 described in reference to FIG. 2. The foam base 76 is shaped in the form of a sofa. All or most of the outer surface of the foam base 76 that is covered with the polymeric solidifying layer 82 is also covered with a primer layer (not shown) substantially similar to primer layer 16 described in reference to FIG. 2. All or most of the primer layer is substantially covered with a decorative layer (not shown) substantially similar to decorative layer 16 described in reference to FIG. 2. The preferred height "D" of the foam base 76 (including the polymeric solidifying layer 82) in this embodiment is about 30.0 inches. The preferred length "E" of the foam base 76 (including the polymeric solidifying layer 82) in this embodiment is about 94.0 inches. The preferred width of the foam base (extending into the page) in this embodiment is about 10.0 inches. Although specific dimensions are given for the particular embodiment shown in FIG. 5, other embodiments of the invention may include differently shaped and sized foam blocks including foam blocks used to form different types of furniture such as chairs, sofas, tables, beds, and other similar furniture pieces.

Figure 6:
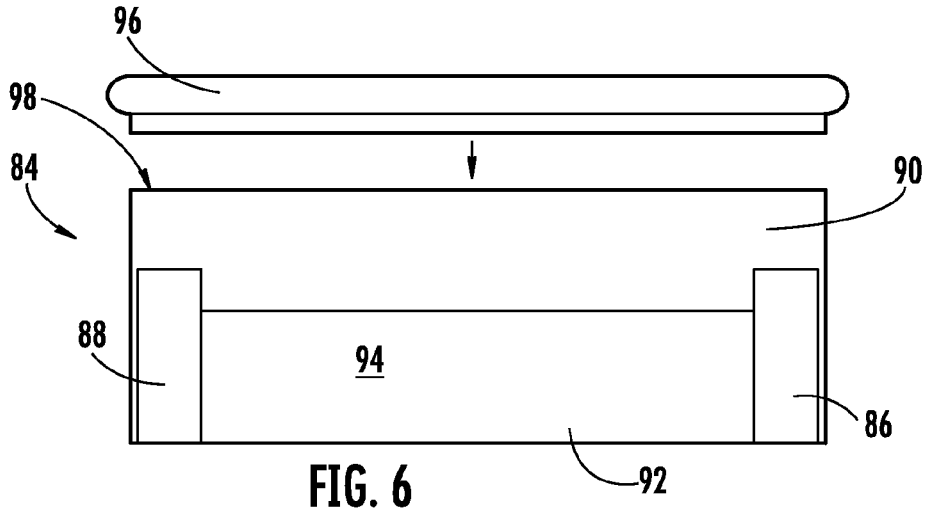
FIG. 6 shows a frontal view of an embodiment of a partially completed multi-layered foam furniture piece with a head rest member being lowered thereon.
Figure 7:
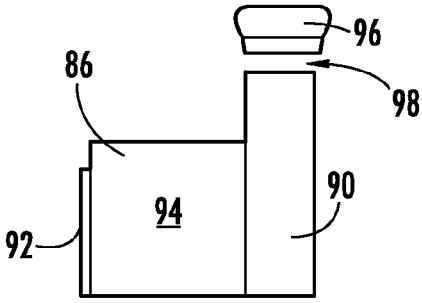
FIG. 7 shows a side view of an embodiment of a partially completed multi-layered foam furniture piece with a head rest member being lowered thereon.
Figures 8A, 8B:
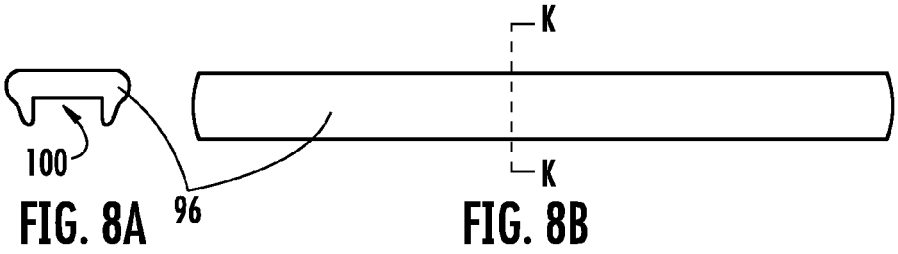
FIG. 8A shows a cutaway view of an embodiment of a head rest member.
FIG. 8B shows a top view looking down on an embodiment of a head rest member.
Figure 9A:
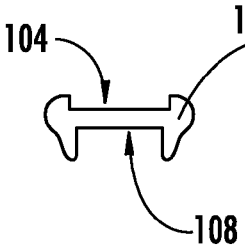
FIG. 9A shows a cutaway view of an embodiment of a head rest member.
Figure 9B:
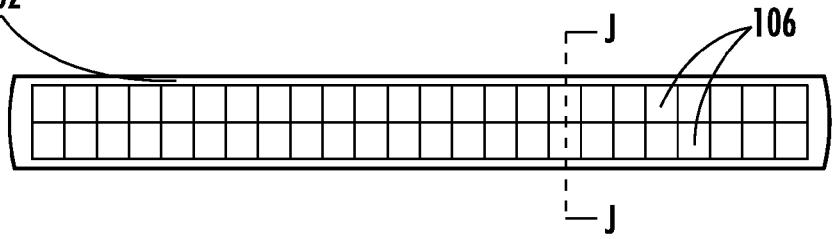
FIG. 9B shows a top view looking down on an embodiment of a head rest member.

FIGS. 6-7 show a foam base 84 including a first side foam block 86, a second side foam block 88, a back foam block 90, and a bottom foam block 92. The foam base 84 shown in FIGS. 6-7, is substantially covered with a polymeric solidifying layer 94 that is substantially similar to the polymeric solidifying layer 14 described in reference to FIG. 2. In the embodiment shown in FIGS. 6-7, the foam base 84 is shaped in the form of a sofa. A first head rest member 96 is attached to a top surface 98 of the back foam block 90. FIG. 8A shows a cutaway view of the first head rest member 96 (cut along line K-K as shown in FIG. 8B) including a channel 100 for attaching the first head rest member 96 to the back foam block 90 along the top surface 98. FIG. 9A shows a cutaway view of a second head rest member 102 (cut along line J-J as shown in FIG. 9B) including a depression 104 for attaching one or more decorative plates (such as tiles 106) and a channel 108 for attaching the second head rest member 102 to the back foam block 90 along the top surface 98. In this embodiment, the tiles 106 are attached to the second head rest member 102 in the same manner as the tiles 72 are attached to the second arm rest member 64. If the second head rest member 102 is to be used on a furniture piece outdoors, the tiles 106 are preferably porcelain tiles. In order to provide permanent fixation between head rest members and a foam block, head rest members (such as the second head rest member 102) may be adhered to a foam block (such as the foam block 90) using an adhesive or other attachment means known to a person having ordinary skill in the art. All or most of the outer surface of the foam base 84 that is covered with the polymeric hard coat 94 is also preferably covered with a primer layer (not shown) substantially similar to the primer layer 18 described in reference to FIG. 2. All or most of the primer layer is substantially covered with a decorative layer (not shown) substantially similar to the decorative layer 16 described in reference to FIG. 2.

It has been found that in certain embodiments that include tile (e.g., the embodiments shown in FIGS. 4C, 4D, 9A, and 9B), the tiles tend to crack for various reasons. Moreover, use of tiles adds significant weight relative to the overall weight of a furniture piece such as, for example, the furniture piece shown in FIG. 6. One solution to this problem is the use of lightweight high density polyurethane foam panels that are reinforced with layers of fiberglass netting for arm rests and headrests. Such composite materials are lightweight but very durable and capable of being selectively shaped for specific design requirements. A specific example of polyurethane foam fiberglass composite paneling that may be used is CFR Series board and Nautical Series board available from Coosa Composites, LLC of Pelham, Ala.

Figure 10A:
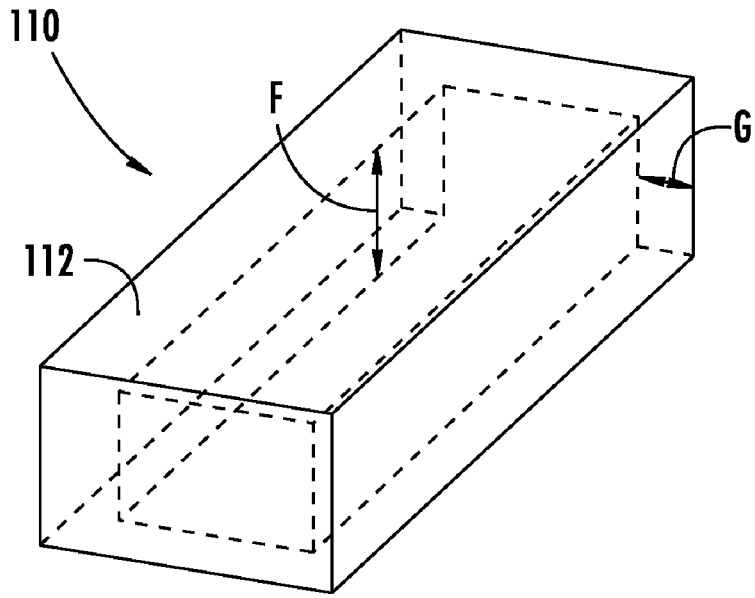
FIG. 10A shows a perspective view of an auxiliary furniture piece component in the form of an armrest.
Figure 10B:
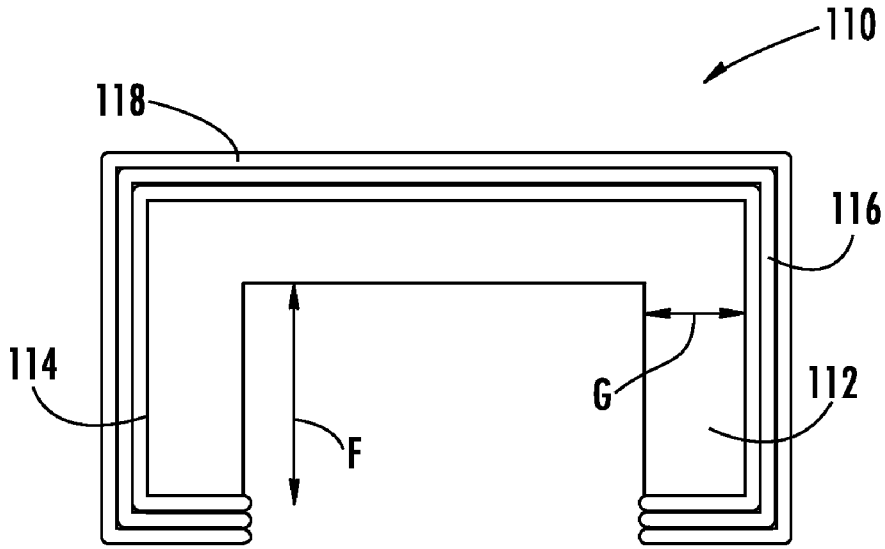
FIG. 10B shows a cutaway view of the auxiliary furniture piece component shown in FIG. 10A.

FIGS. 10A and 10B shows an embodiment of an armrest 110—an example of an auxiliary furniture piece component—that includes a composite panel 112 that has been cut so as to fit as an armrest over, for example, the first side foam block 62 of the foam base 76 shown in FIG. 5. Decorative features may be cut into the composite panel 112 prior to the addition of any layers to the composite panel 112. As an example, the armrest composite 112 includes an interior height F of 1.5 inches and an average thickness G of 0.5 inches. Dimensions for composite panels will vary depending on the particular design and application (e.g., a composite panel used to form part of a headrest instead of an armrest). The armrest 110 further includes a polymer cement layer 114 (similar or identical to the polymer cement layer 36) and a pigment layer 116 (similar or identical to the pigment layer 50). The armrest 110 shown in FIG. 10 also includes a sealant layer 118 that is similar or identical to the sealant layer 52.

Figure 11:
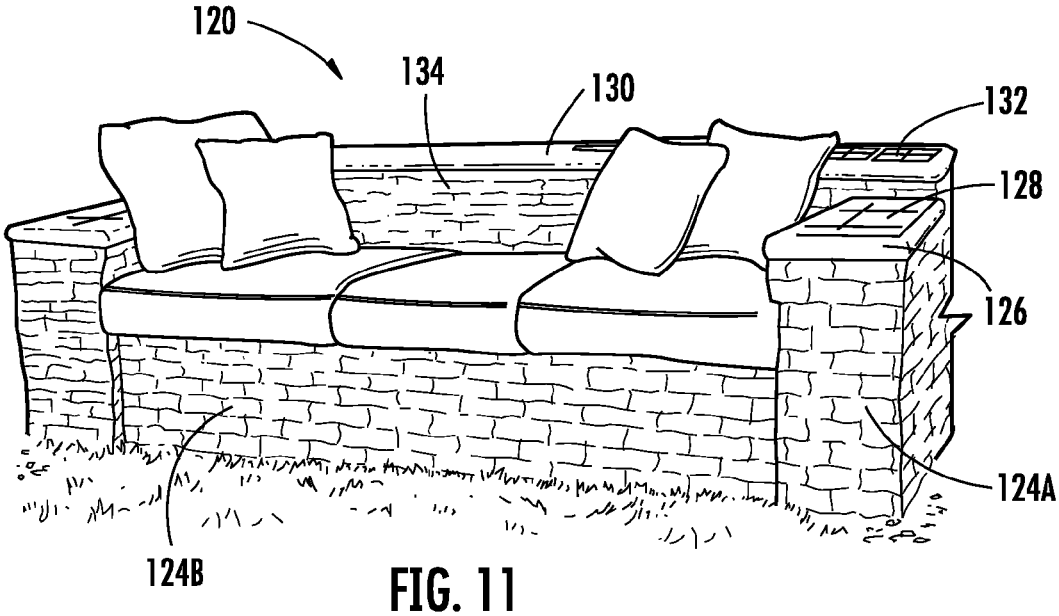
FIG. 11 shows a perspective view of an embodiment of a multi-layered foam furniture piece.

FIG. 11 shows an embodiment of a multi-layered foam furniture piece 120 with a layer structure substantially similar to the layers described above in reference to the embodiment shown in FIG. 2. The furniture piece 120 includes a decorative layer 122 that includes a plurality of decorative plates (e.g., 124A and 124B) that give the look of stacked stone. The furniture piece 120 also includes a first arm rest member 126 (similar to the second arm rest member 64) including a plurality of first arm rest member tiles 128 thereon. The furniture piece 120 further includes a head rest member 130 (similar to the second head rest member 102) including a plurality of head rest member tiles 132 thereon. The head rest member 130 is slightly arched to conform to the slightly arched upper surface of a back foam block 134.

Figure 12:
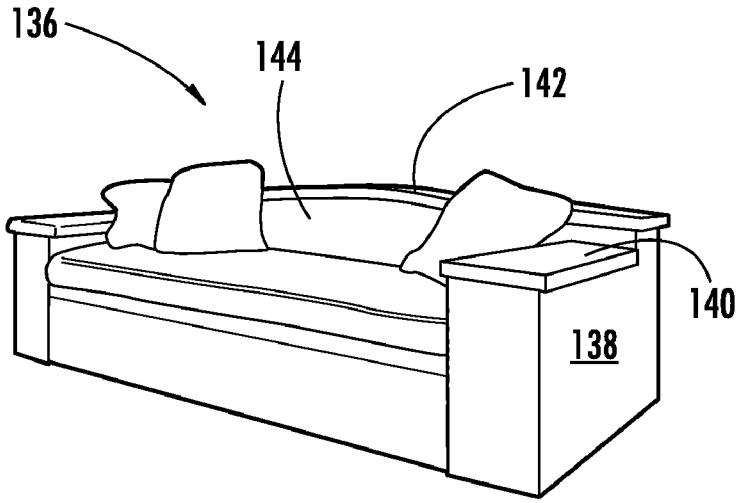
FIG. 12 shows a perspective view of an embodiment of a multi-layered foam furniture piece.

FIG. 12 shows another embodiment of a multi-layered foam furniture piece 136 including a layer structure substantially similar to the layers described above in reference to embodiment shown in FIG. 2. The furniture piece 136 includes a decorative layer 138 that includes an acrylic-based surface finish. The furniture piece 136 also includes a first arm rest member 140 (similar to the first arm rest member 60). The furniture piece 136 further includes a head rest member 142 (similar to the first head rest member 96). The head rest member 142 is slightly arched to conform to the slightly arched upper surface of a back foam block 144.

Figure 13:
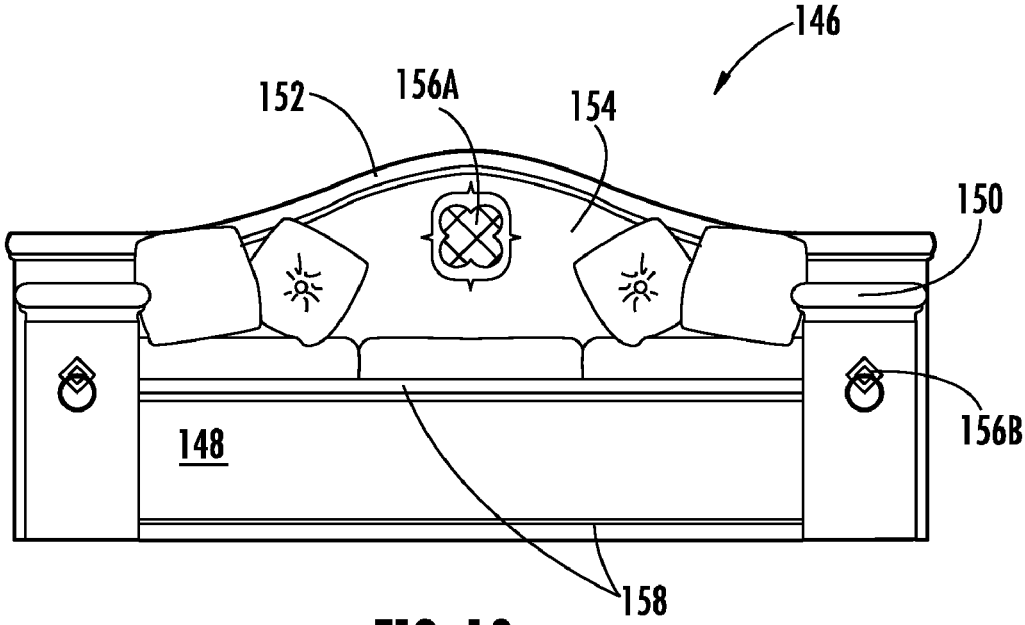
FIG. 13 shows a frontal view of an embodiment of a multi-layered foam furniture piece.

FIG. 13 shows yet another embodiment of a multi-layered foam furniture piece 146 including a layer structure substantially similar to the layers described above in reference to the embodiment shown in FIG. 2. The furniture piece 146 includes a decorative layer 148 that includes an acrylic-based surface finish. The furniture piece 146 also includes a first arm rest member 150 (similar to the first arm rest member 60). The furniture piece 146 further includes a head rest member 152 (similar to the first head rest member 96). The head rest member 152 includes a more pronounced arch shape than the embodiment shown in FIG. 12 so that the head rest member 152 substantially conforms to the arched upper surface of a back foam block 154. The furniture piece 146 also includes decorative plates 156A and 156B. The decorative plates 156 shown in this embodiment include metal ornamental structures. Such ornamental structures are available, for example, from Van Dyke's Restorers of Mitchell, S. Dak. The furniture piece 156 also includes a pair of decorative molding structures 158 along a portion of the exterior surface of the furniture piece 146.

Figure 14:
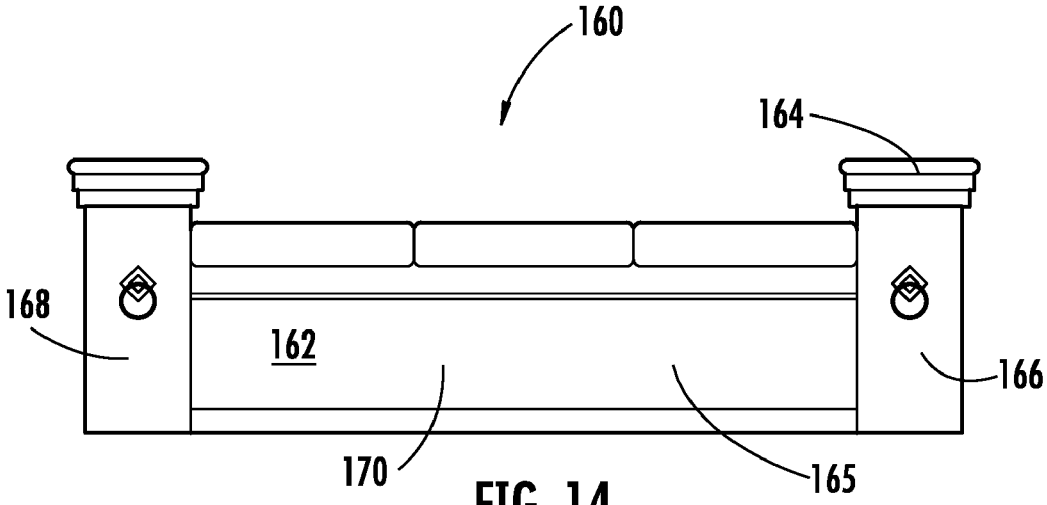
FIG. 14 shows a frontal view of an embodiment of a multi-layered foam furniture piece.

Another embodiment of a furniture piece 160 is shown in FIG. 14 that is similar to the embodiment described in FIG. 13. The furniture piece 160 is formed with a layer structure substantially similar to the layers described above in reference to the embodiment shown in FIG. 2. The furniture piece 160 includes a decorative layer 162 that includes an acrylic-based surface finish. The furniture piece 160 also includes a first arm rest member 164 (similar to the first arm rest member 60). The underlying layer of the furniture piece 160 (i.e., the foam base 165) includes a first side foam block 166, a second side foam block 168, and a bottom foam block 170. However, the embodiment shown in FIG. 14 does not include a back foam block.

Figure 15:
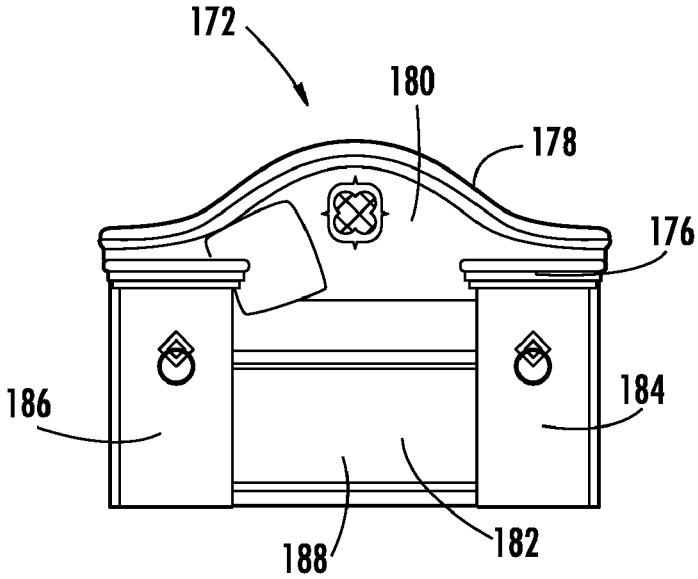
FIG. 15 shows a frontal view of an embodiment of a multi-layered foam furniture piece.

The embodiment shown in FIG. 15 includes a furniture piece 172 in the shape of a chair. The physical characteristics of the furniture piece 172 are substantially similar to furniture piece 146 shown in FIG. 1 except for a visible variation in length. The furniture piece 172 includes a layer structure substantially similar to the layers described above in reference to the embodiment shown in FIG. 2. The furniture piece 172 also includes a decorative layer 174 that includes an acrylic-based surface finish. The furniture piece 172 also includes a first arm rest member 176 (similar to the first arm rest member 60). The furniture piece 172 further includes a head rest member 178 (similar to the first head rest member 96). The arch shape of the head rest member 178 allows it to conform to the arched upper surface of a back foam block 180. The underlying layer of the furniture piece 172 (i.e. a foam base 182) includes the back foam block 180, a first side foam block 184, a second side foam block 186, and a bottom foam block 188.

Figure 16:
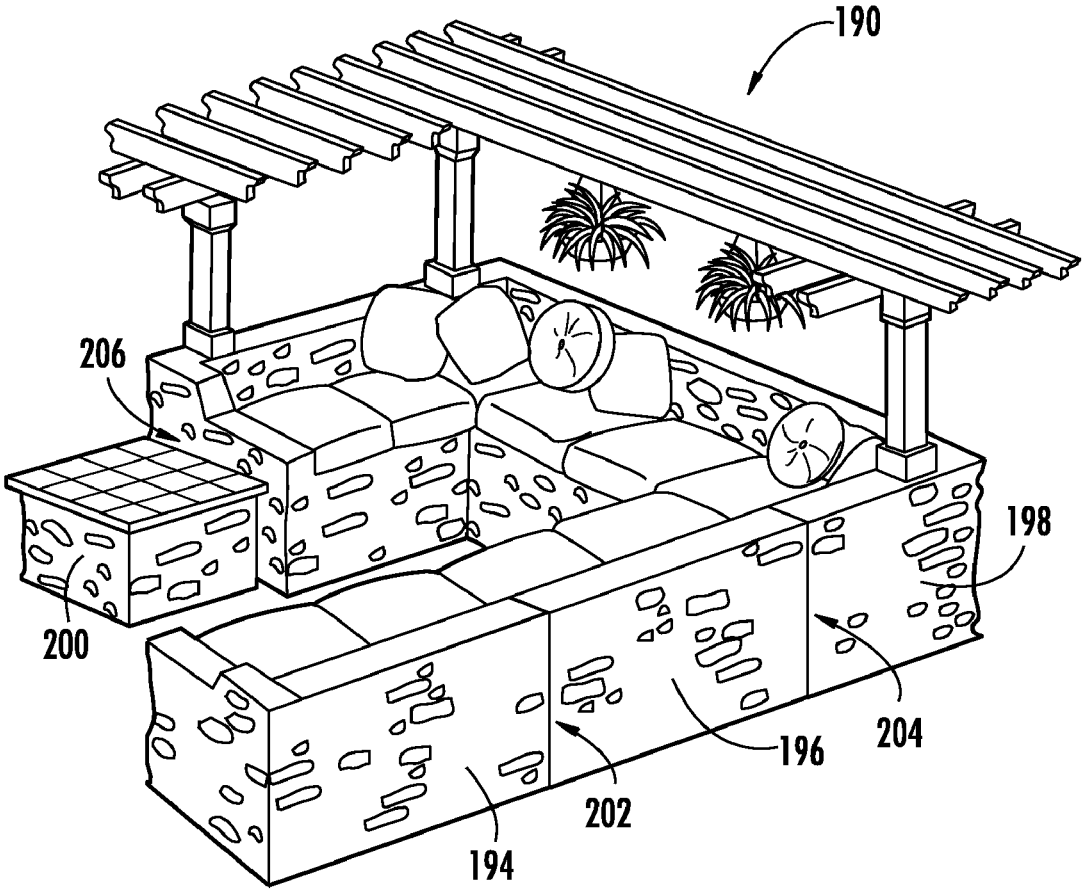
FIG. 16 shows a perspective view of an embodiment of a multi-layered foam furniture piece including a plurality of subpieces.
Figure 17:
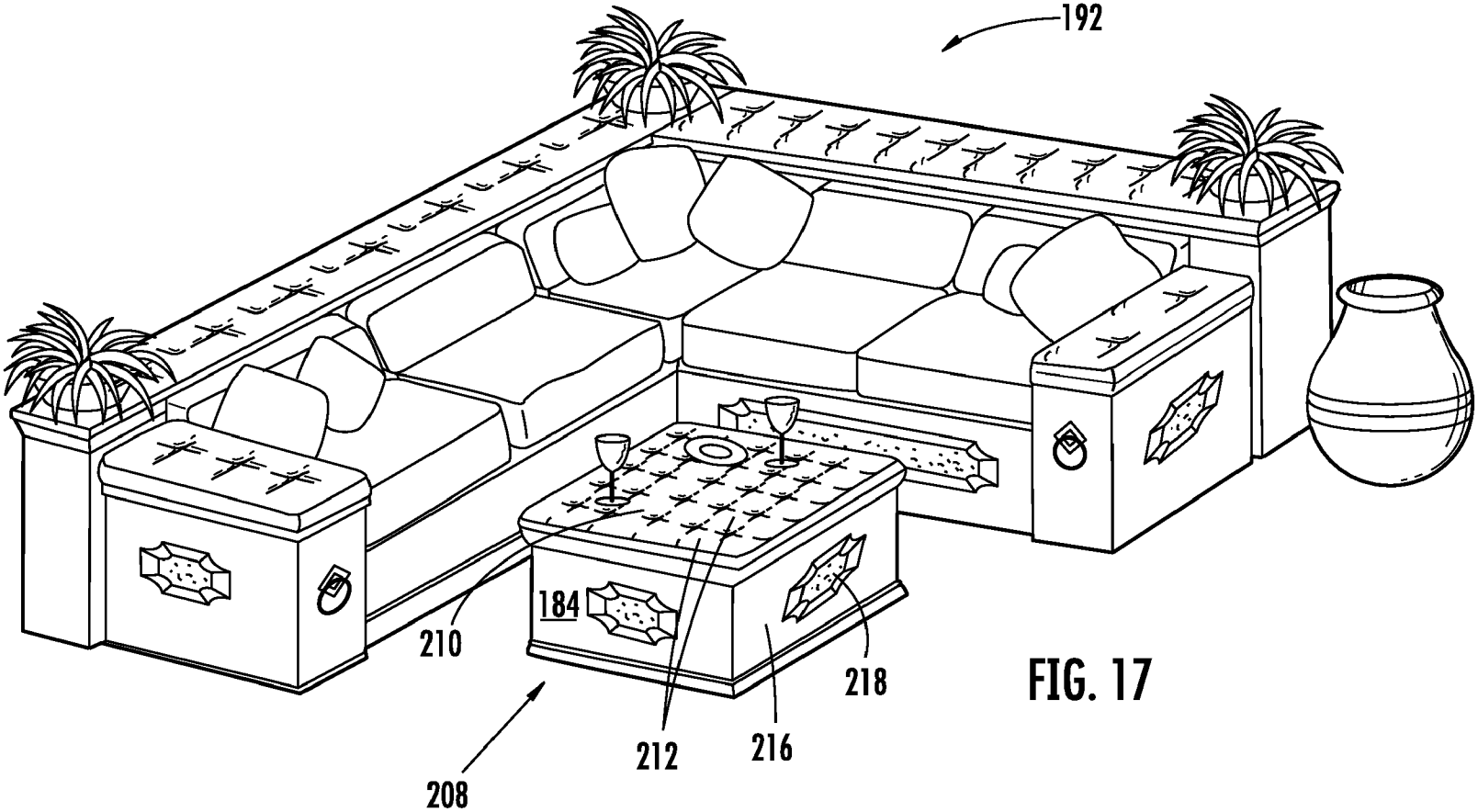
FIG. 17 shows a perspective view of an embodiment of a multi-layered foam furniture piece including a plurality of subpieces.

FIGS. 16-17 show two additional embodiments including a furniture piece 190 and a furniture piece 192, both of which have a layered structure similar to the embodiment shown in FIG. 2. The furniture piece 190 includes subpieces including a first subpiece 194, a second subpiece 196, a third subpiece 198, and a fourth subpiece 200. The subpieces (194, 196, 198, and 200) may be separated from one another and rearranged as with other modular furniture pieces known to a person having ordinary skill in the art. The separations between subpieces (194, 196, 198, and 200) may occur along lines 202, 204, and/or 206. In addition to furniture piece 192, FIG. 17 also shows a furniture piece 208 in the form of a table. The furniture piece 208 has a layer structure similar to the embodiment shown in FIG. 2. The furniture piece 208 includes a top surface 210 covered with decorative panels in the form of tiles 212. The outer side surface 214 includes a decorative layer 216 that includes an acrylic-based surface finish and decorative panels in the form of metal ornamental structures 218.

Figure 18:
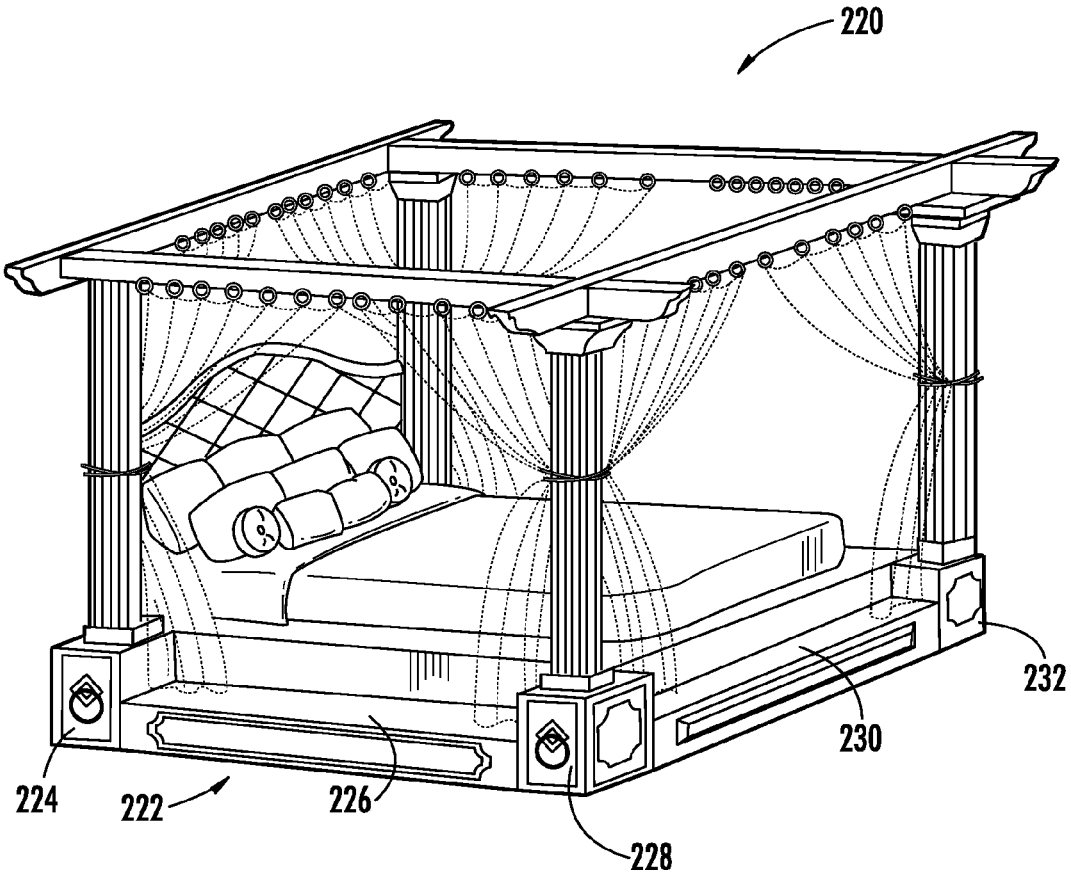
FIG. 18 shows a perspective view of an embodiment of a multi-layered foam furniture piece.

FIG. 18 shows another furniture piece 220 in the form of a bed. The furniture piece 220 has a multi-layered structure similar to the embodiment shown in FIG. 2. The furniture piece 220 includes a foam base 222 that further includes one or more foam blocks such as foam blocks 224, 226, 228, 230, and 232 (with other layers added thereon as described with reference to FIG. 2). In the embodiment shown in FIG. 18, the foam base 222 is made to conform to the shape of a bed.

Having described various embodiments of multi-layered foam furniture pieces that embody the technology described herein, the focus now shifts to methods for making such multi-layered foam furniture pieces. In one such embodiment, as shown in FIG. 19, a method for making a multi-layered furniture piece as described above includes a cutting step 302 that includes cutting a first foam block to a first desired shape including a first furniture portion. During the cutting step 302, one or more foam blocks are cut to a desired shape, forming a furniture portion. For example, a furniture piece such as the furniture piece shown in FIG. 3B requires different shaped furniture portions to form the foam base 30. Some furniture portions may need to be rounded or cut into very specific and unique shapes such as, for example, the back foam block 154 shown in FIG. 13. The cutting step may be accomplished by many cutting techniques known to a person having ordinary skill in the art. One such cutting technique includes using a large heated electric wire cutter such as the Styrocut 15 available from Demand Products, Inc. of Alpharetta, Ga.

If more than one furniture portion is necessary to form a furniture piece, the separate furniture portions are attached to one another. The attaching step 304, if necessary, is preferably accomplished using one or more adhesives such as, for example, Great Stuff™ available from Dow Chemical Company of Midland, Mich. or Foam-Lok™ available from LaPolla Industries, Inc. of Houston, Tex. However, other attachment methods known to a person having ordinary skill in the art for attaching foam blocks to one another may be used. After the attaching step 304 is substantially complete, the separate furniture portions form a single foam base such as foam base 30 shown in FIG. 3B.

The method further includes a first application step 306 that includes applying a polymeric solidifying layer to at least part of the outer surface area of a furniture portion or a foam base. In one embodiment, the first application step 306 includes spray mixing one or more applications of chemicals that form a polymeric solidifying layer over the furniture portion or furniture base. Other techniques may be used to accomplish the first application step 306 other than spray mixing including, for example, rolling. Preferably, the entire outer surface of the furniture portion or the foam base is coated with the polymeric solidifying layer.

For embodiments that do not include a polymer cement layer (e.g., the polymer cement layer 36), a primer layer (e.g., the primer layer 18) is preferably applied to at least part of the surface area where the polymeric solidifying layer was applied. Thus, an alternative application step 308 includes applying a primer layer. The primer layer may also be applied to surface areas (if any) where no polymeric solidifying layer is present on the furniture portion or the foam base. For applicable embodiments, it is preferable that the entire polymeric solidifying layer is coated with the primer layer. The primer layer is preferably sprayed on, but other application techniques known to a person having ordinary skill in the art may be used such as, for example, brushing or rolling.

After the alternate application step 308, if applicable, one or more decorative layers may be applied. A decorative application step 310 includes applying a decorative layer (e.g., the decorative layer 16) to the furniture portion or the foam base. For embodiments that do not include a polymer cement layer, the decorative application step is preferably accomplished by spray mixing the decorative layer or layers on to a furniture portion or, additionally or alternatively, attaching one or more decorative plates to the furniture portion. Other exemplary application techniques include, for example, brushing or rolling. For embodiments that do include a polymer cement layer, the decorative application step 310 includes dusting the furniture portion or foam base with aggregate material as described herein with regard to the embodiment shown in FIG. 3B. The dusting is preferably completed while the polymeric solidifying layer is still tacky (i.e., before it substantially hardens).

In certain embodiments, an optional reinforcing step 312 is included during or prior to dusting the furniture portion or foam base. The reinforcing step 312 includes applying one or more mesh netting patches to cover at least a part of the outer surface area of the furniture portion or the foam base. Mesh netting may be applied along the entire surface of the furniture piece or in specific areas that are more likely to experience wear. The reinforcing step 312 could be thought of an extension of the first application step 306.

A preferred embodiment includes a cement application step 314. The cement application step 314 includes applying a polymer cement layer to the furniture portion or the foam base. The polymer cement layer is typically applied proximate to the decorative layer and/or the mesh netting, if any. The cement application step 314 may be further subdivided into separate application steps for applying, for example, a first polymer cement layer (a "base coat") and a second polymer cement layer (a "top coat"). The polymer cement layer is preferably applied by troweling techniques although other techniques may be used.

Preferably, for embodiments that include a polymer cement layer, a method for making a lightweight multi-layered foam furniture piece further includes a coloring step 316. The coloring step 316 includes applying a pigment layer to at least part of the polymer cement layer after the polymer cement layer has substantially hardened.

In a preferred embodiment, the method including the cement application step 314 further includes a sealing step 318. The sealing step 318 includes applying a sealant layer to at least part of the polymer cement layer 314. The sealing step may also be included for embodiments that include the coloring step 316 in which case the sealant layer is applied to at least a portion of the pigment layer.

A preferred embodiment includes auxiliary steps. The auxiliary steps include preparing an auxiliary member such as an arm rest or a head rest wherein a composite panel is used instead of a foam block. As with the foam block (or blocks), a first step is an auxiliary cutting step 320 wherein the composite panel is cut to a specific size and shape according to the particular application. In the case of an armrest, for example, a composite panel would be cut to resemble the armrest 110 shown in FIG. 10. Additional steps include an auxiliary cutting step 322 that is virtually the same as the cutting step 302 (except a composite panel is being cut instead of a foam block). Then, an auxiliary cement application step 324 that parallels the cement application step 314 adds a polymer cement layer to the previously cut composite panel. The polymer cement layer is preferably applied using trowel techniques; however other applying techniques known to a person having ordinary skill in the art may be used. The cement application step 324 preferably includes an auxiliary base coat cement application step 324A and an auxiliary top coat cement application step 324B. A further step includes an auxiliary coloring step 326 that parallels the coloring step 316. The auxiliary coloring step 326 includes applying a pigment layer proximate to at least a part of the polymer cement layer. The composite panel with its various layers may be attached to a furniture portion or a foam base during an auxiliary attachment step 328. The auxiliary attachment step is preferably accomplished using an adhesive although other attachment techniques may be used. The auxiliary attachment step 328 preferably occurs before the auxiliary cement application step 324 so that any spaces between the composite panel and the foam base may be troweled over and substantially sealed.

The previously described embodiments of the present invention have many advantages, including providing furniture pieces that are easily moved from a first location to a second location. In contrast, a furniture piece made using actual bricks or rocks would be very difficult, time consuming, and expensive to move. Moreover, certain heavy furniture pieces made from many pieces of stone and or brick that are custom made for specific homes or buildings may be deemed as fixtures of the home or building, thereby causing such structures to legally remain with the home or building when sold. Furniture pieces made using the methods described herein, however, would be much less likely to be deemed as fixtures because of the ease by which such furniture pieces may be moved from a first location to a second location. Another advantage of furniture pieces made using the methods described herein includes the relatively low costs of manufacturing such products as compared to furniture with a similar appearance made from actual stone, brick, coral, or other similar materials. Polystyrene foams are prone to chip or bead off, so the polymeric solidifying layer and the polymer cement layer (if applicable) minimize this problem. Additionally, polystyrene foam (if used as the base foam), the polymeric solidifying layer, the polymer cement layer (if applicable), and the sealant layer (if applicable) are all very resistant to moisture, mold, and other elements or forces that tend to weather furniture such as UV radiation. The polymeric solidifying layer and the polymer cement layer (if applicable) are also very robust with regard to potential damage caused by direct impact from foreign objects. For example, when CenturyStone mixtures are used to form the polymer cement layer, about 72 hours after the polymer cement coat has substantially hardened, the polymer cement layer exhibits a compressive strength of about 3000 psi. Continuing with this example, about 28 days after the polymer cement coat has substantially hardened, the polymer cement layer exhibits a compressive strength of about 9000 psi. Another significant advantage of virtually all of the embodiments discussed herein is that the materials used to manufacture furniture pieces (e.g., polystyrene) are easily recyclable. As new legislative changes regarding waste and pollution increase penalties and rewards related to conservation, a product that is almost 100% recyclable is considerably desirable.

The foregoing description of preferred embodiments for this invention has been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

Any element in a claim that does not explicitly state "means for" performing a specified function, or "step for" performing a specific function, is not to be interpreted as a "means" or "step" clause as specified in 35 U.S.C. §112, ¶ 6. In particular, the use of "step of" in the claims herein is not intended to invoke the provisions of 35 U.S.C. §112, ¶ 6.

What is claimed is:

1. A multi-layered foam furniture piece, comprising: a foam base, the foam base comprising a plurality of foam blocks adhesively attached together in the configuration of a furniture piece wherein a majority of the space between the plurality of foam blocks that are adhesively attached together consists of adhesive material used to attach the plurality of foam blocks together, a polymeric solidifying layer applied in a fluid state over at least a portion of the exposed outer surface of the foam base to conform thereto, and a decorative layer at least partially applied in a fluid state over at least a portion of the polymeric solidifying layer to conform thereto, the solidifying layer and the decorative layer hardening to yield a multilayered foam furniture piece including a hardened outer shell.

2. The furniture piece of claim 1, wherein the decorative layer comprises at least one design plate attached adjacent to the polymeric solidifying layer.

3. The furniture piece of claim 1 further comprising a primer layer attached adjacent to at least a part of the polymeric solidifying layer and proximate to the decorative layer.

4. The furniture piece of claim 1 further comprising a polymer cement layer attached adjacent to the decorative layer.

5. The furniture piece of claim 4 further comprising a pigment layer attached adjacent to the polymer cement layer.

6. The furniture piece of claim 5 further comprising a sealant layer attached adjacent to the pigment layer.

7. The furniture piece of claim 1 further comprising a mesh netting patch attached adjacent to the polymeric solidifying layer.

8. A multi-layered foam furniture piece, comprising: a foam base wherein such foam consists essentially of a foam selected from the group consisting of extruded polystyrene foam (XPS), polyurethane foam, polyethylene foam, polyvinylchloride foam and combinations thereof, the foam base comprising a plurality of foam blocks adhesively attached together in the configuration of a furniture piece wherein a majority of the space between the plurality of foam blocks that are adhesively attached together essentially consists of adhesive material used to attach the plurality of foam blocks together; a polymeric solidifying layer applied in a fluid state over at least a portion of the exposed outer surface of the foam base to conform thereto; and a decorative layer at least partially applied in a fluid state over at least a portion of the polymeric solidifying layer to conform thereto, the solidifying layer and at least a portion of the decorative layer hardening to yield a multilayered foam furniture piece including a hardened outer shell.

9. A method for making a multi-layered foam furniture piece comprising the steps of:

(a) cutting a first foam block to a first desired shape including a first furniture portion;

(b) cutting a second foam block to a second desired shape including a second furniture portion;

(c) attaching the first furniture portion to the second furniture portion to form a foam base, wherein a majority of the space between the first foam block and the second foam block that are adhesively attached together consists of adhesive material used to attach the first foam block and the second foam block together;

(d) applying a polymeric solidifying layer in a fluid state over at least part of the exposed outer surface of the foam base; and (e) applying a decorative layer at least partially in a fluid state over at least a portion of the polymeric solidifying layer to conform thereto;

(f) allowing the solidifying layer and the decorative layer to harden to yield a multilayered foam furniture piece including a hardened outer shell.

10. The method of claim 9 further comprising a step of applying a primer layer adjacent to the polymeric solidifying layer.

11. The method of claim 10 wherein step (e) further comprises a step of attaching a design plate to the primer layer.

12. The method of claim 9 further comprising a step of applying a polymer cement layer adjacent to the decorative layer.

13. The method of claim 12 further comprising a step of applying a pigment layer adjacent to the polymer cement layer.

14. The method of claim 13 further comprising a step of applying a sealant layer proximate to the pigment layer.

15. The method of claim 12 further comprising a step of applying a sealant layer adjacent to at least a portion of the polymer cement layer.

16. The method of claim 10 wherein step (d) further comprises a step of reinforcing the polymeric solidifying layer by applying a mesh netting patch adjacent to the polymeric solidifying layer.

* * * * *